US005996851A

United States Patent [19]

Dolan et al.

[11] Patent Number: 5,996,851

[45] Date of Patent: Dec. 7, 1999

[54] BLADDER-OPERATED DISPENSER

[75] Inventors: Michael J. Dolan, Akron; John M. Tosill, Barberton; Edward L. Aman, Akron, all of Ohio

[73] Assignee: GOJO Industries, Inc., Cuyahoga Falls, Ohio

[21] Appl. No.: 09/161,560

[22] Filed: Sep. 28, 1998

[51] Int. Cl.[6] ..... B67D 5/06

[52] U.S. Cl. ..... 222/179; 222/181.3

[58] Field of Search ..... 222/179, 181.3, 222/181.1, 206

[56] References Cited

U.S. PATENT DOCUMENTS

| | | | |
|---|---|---|---|
| D. 298,897 | 12/1988 | Blaich et al. | D6/545 |
| D. 379,279 | 5/1997 | Brandenburg et al. | D6/519 |
| 3,197,081 | 7/1965 | Midworth | 222/179 |
| 3,495,571 | 2/1970 | Evans | 118/325 |
| 3,568,635 | 3/1971 | Poitras et al. | 118/122 |
| 3,652,053 | 3/1972 | Poitras et al. | 251/38 |
| 3,952,918 | 4/1976 | Poitras et al. | 222/82 |
| 3,952,924 | 4/1976 | Benson | 222/181 |
| 4,187,845 | 2/1980 | Dror | 128/205.13 |
| 4,489,857 | 12/1984 | Batlas | 222/179 |
| 4,539,005 | 9/1985 | Greenblatt | 604/141 |
| 4,564,127 | 1/1986 | Garabedian et al. | 222/96 |
| 4,573,612 | 3/1986 | Maddison et al. | 222/94 |
| 4,679,709 | 7/1987 | Poitras et al. | 222/180 |
| 4,762,124 | 8/1988 | Kerch et al. | 128/156 |
| 5,115,948 | 5/1992 | Johnson | 222/209 |
| 5,265,772 | 11/1993 | Bartasevich et al. | 222/214 |
| 5,269,444 | 12/1993 | Wright | 222/190 |
| 5,312,018 | 5/1994 | Evezich | 222/95 |
| 5,398,845 | 3/1995 | Meyer | 222/1 |
| 5,427,279 | 6/1995 | Kaufman | 222/207 |

*Primary Examiner*—Joseph A. Kaufman
*Assistant Examiner*—Keats Quinalty
*Attorney, Agent, or Firm*—Reese Taylor

[57] ABSTRACT

A bladder assembly for operating a dispenser for fluid material. The dispenser includes a hinged pressure bar movable into and out of collapsing engagement with a collapsible tube which leads from a source of supply of the material to be dispensed. The bladder assembly includes a flexible bladder in fluid communication with a foot pump. The bladder is removably located within the dispenser behind the pressure bar so that inflation of the bladder by pumping air into it through a hose from the foot pump moves the pressure bar into collapsing engagement with the tube to dispense the material.

5 Claims, 4 Drawing Sheets

BLADDER-OPERATED DISPENSER

RELATED PATENT APPLICATIONS

None.

FIELD OF THE INVENTION

This invention relates in general to dispensers for liquid material and relates in particular to a dispenser of the type in which the liquid material is carried in a cartridge which is mounted in the dispenser and has a nozzle carrying, collapsible tube depending therefrom so that collapse of the tube forces a measured charge of the material to the nozzle. More particularly, the invention relates to such a dispenser wherein the tube is collapsed by a mechanism actuated by foot pressure which creates a pneumatic force on a bellows which expands to collapse the tube.

BACKGROUND OF THE INVENTION

In the art of dispensing liquid material and particularly viscous liquid material such as soap, lotion, etc., it is commonly known to provide dispensers which, in many instances, are wall mounted. These dispensers receive replaceable cartridges which contain the liquid material and which, in many instances, dispense the material from the cartridge through a collapsible tube and ultimately through a nozzle to the exterior of the dispenser.

Such dispensers generally operate by providing a hand-actuated lever or handle which, when activated by either pushing it toward the dispenser or pulling it away, causes collapse of the tube through an internal mechanism which engages and compresses the tube. Such collapse of the tube then forces a measured amount of the material out through the nozzle. Such a dispenser can be seen, for example, in Bartasevich U.S. Pat. No. 5,265,772 wherein the handle 31 is moved inwardly and the pressure member 31*c* collapses the tube 62 against a backup member or platen 54 to thus expel the material onto the hand of the user.

While dispensers of this general type have found wide acceptance in the art, it should be kept in mind that the ultimate purpose of dispensing the material, particularly in the instance wherein the material is soap, is sanitation. Furthermore, dispensers of this type are found in public areas as well as in the home and, therefore, countless individuals engage the hand-operated lever or handle to actuate the dispenser, thereby increasing the possibility of contamination and transmittal of germs. Furthermore, dispensers of this type are often used in healthcare or food handling environments where high levels of sanitization are required.

In view of this, it is thought desirable to provide a dispenser of this type in which the hand of the recipient of the material, such as soap, never comes into contact with the dispenser itself.

In accomplishment of this desired result, it is believed desirable to be able to actuate the dispenser in a "hands-free" fashion.

Hands-free dispensers have, therefore, been developed and examples can be found in the prior patent art. For example, Evezich U.S. Pat. No. 5,312,018 discloses a dispenser with a foot pedal with a bellows which forces air directly into a collapsible cartridge. Wright U.S. Pat. No. 5,269,444 is similar in showing the use of air introduced into the cartridge to assist in dispensing the material.

Garabedian U.S. Pat. No. 4,564,127 discloses using a foot pedal to activate a mechanical valve actuator and Dror U.S. Pat. No. 4,187,845 also discloses a foot-operated mechanical linkage as does Midworth U.S. Pat. No. 3,197,081.

Johnson U.S. Pat. No. 5,115,948; Benson U.S. Pat. No. 3,952,924; Meyer U.S. Pat. No. 5,398,845; and Kaufman U.S. Pat. No. 5,427,279 all disclose the use of a bellows to assist in dispensing liquid, although these structures are all hand operated.

While these dispensers are assumed to be adequate for the purposes for which they are designed, still further improvements are believed desirable.

Thus, it is believed to be advantageous to provide a foot-operated dispenser wherein the existing dispensers may be easily retrofitted.

Furthermore, such a modification may be made without impairing the normal, hand-operated function of the dispenser.

Finally, it is believed desirable to provide a very simple apparatus for achieving the hands-free operation with no modification of the existing dispenser.

The present invention is intended to provide such a hands-free actuating apparatus in which foot pressure actuates a bladder which, in turn, acts on the usual pressure member of the dispenser and also to provide one in which existing dispensers of this general type can be simply retrofit, in the field, to provide for such an operation.

SUMMARY OF THE INVENTION

It accordingly becomes the principal object of this invention to provide a dispenser for liquid material which can be operated hands free.

In furtherance of such principal object, it has been found that the basic dispenser of the type discussed herein can be either originally fabricated or retrofitted with a pneumatically-operated bladder which is activated by foot pressure of the user so that the hands of the user never engage the dispensing mechanism at all.

Thus, it has been found that the expandable bladder can be positioned between the dispenser and the pressure member carried by the standard operating handle without any modification of the existing operating apparatus.

It has also been found that a foot pump mechanism can be provided and disposed on the floor with a tube leading from that to the bladder which is mounted internally on the dispenser so that expansion of the bladder by forcing air into it from the foot pump will activate the handle pressure member to collapse the tube and discharge a predetermined amount of material.

Additionally, it has been discovered that, by providing the bladder with a single chamber construction and then folding it about its approximate center, the force imparted to the handle is doubled without requiring the expected corresponding increase in pressure on the foot pump. This enhances its ease of operation for the end user.

Finally, it has been found that addition of the bladder and foot pump, in addition to requiring no modification of the existing structure, also does not impede normal operation of the dispenser through hand actuation.

Accordingly, production of an improved foot-actuated dispenser of the type described herein becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

The dispenser which is the subject of this application is, in general, a dispenser of the type illustrated in Bartasevich U.S. Pat. No. 5,265,772 and the general structure and operation of the dispenser will be described in relatively general terms only. In that regard, before beginning a more specific description of the invention, it should be noted that virtually any push type dispenser of this general type can be retrofitted, in the field, without any modification, with the present invention.

Figure 1:
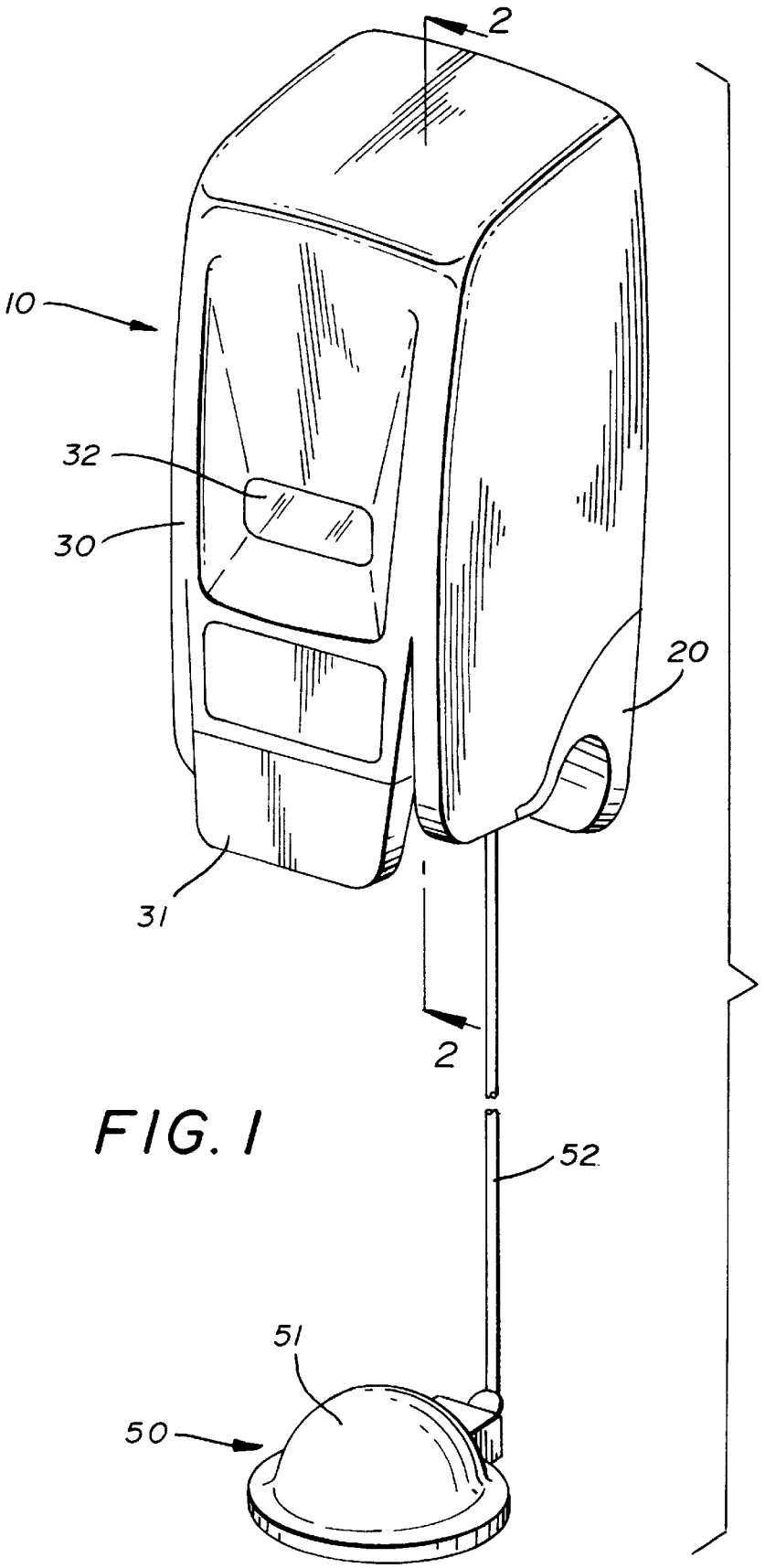
FIG. 1 is a perspective view of the improved dispenser.

To that end, and referring to FIG. 1 of the drawings, it will be seen that the dispenser, generally indicated by the numeral 10, includes a back plate 20 and a cover 30. Cover 30 has an operating handle 31 which is pivotally secured to the cover and a sight window 32 which enables one to view the bag which is carried by the cartridge for purposes of ascertaining the level of supply of the material within the bag.

Still referring to FIG. 1 of the drawings, it will be seen that a foot pump generally indicated by the number 50 includes a flexible collapsible dome 51 and an air supply tube 52 which leads to the dispenser 10 as will be described.

Figure 2:
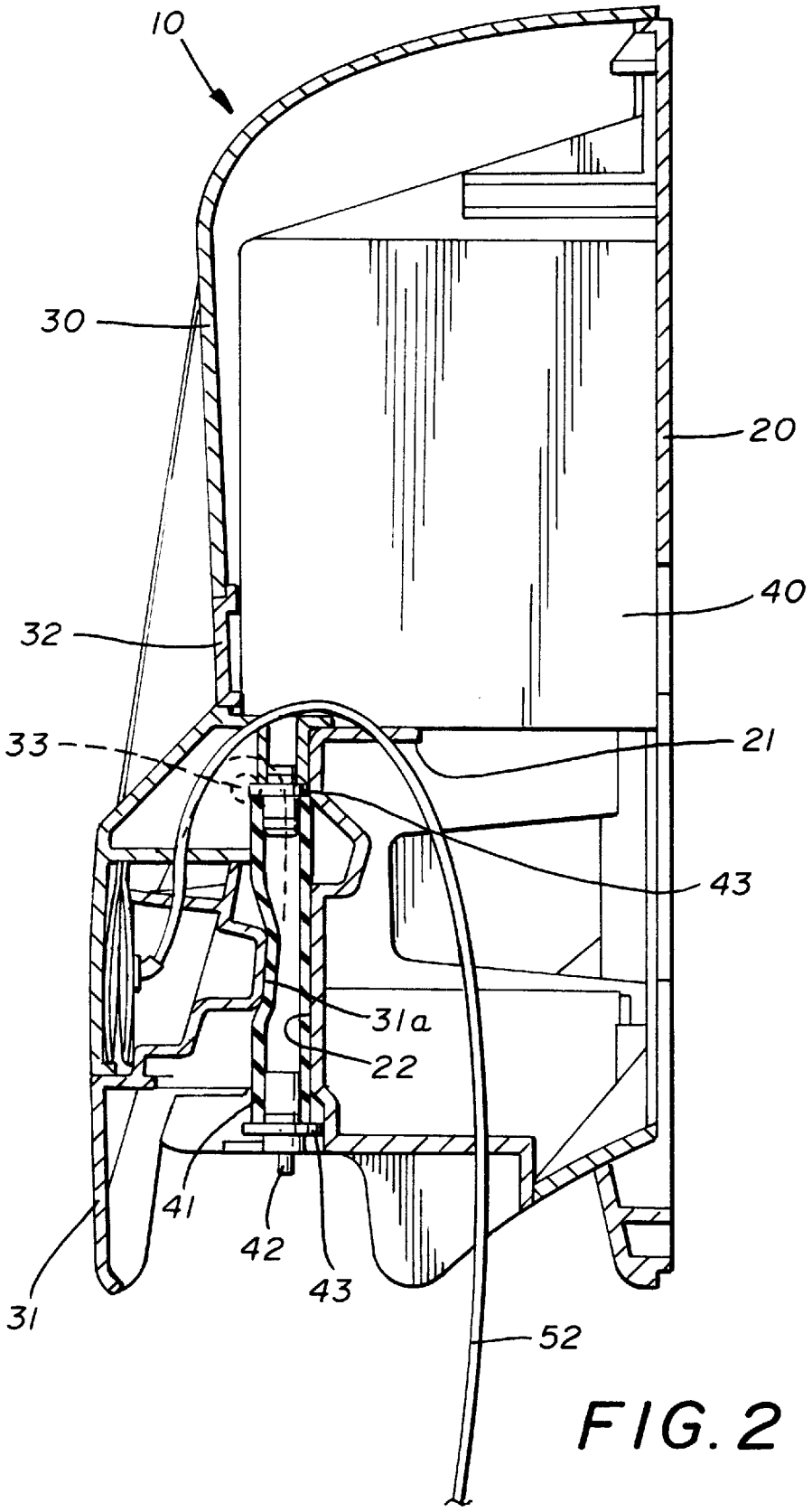
FIG. 2 is a sectional view taken along the line 2—2 of FIG. 1.

Referring next to FIG. 2 of the drawings, it will be seen that the dispenser 10, and particularly the back plate 20, provides a horizontally projecting shelf 21 for supporting a replaceable cartridge 40. This cartridge is of the general "bag-in-box" type well known in the industry and described in greater detail in Bartasevich U.S. Pat. No. 5,265,772. Suffice it to say here that, generally, a cardboard box is provided and a collapsible bag is received within the box. This bag contains the actual soap or other material to be dispensed and has a collapsible tube 41 in fluid communication with the interior of the bag.

As can be seen in FIG. 2 of the drawings, the tube 41 depends from the bag and carries with it fitment members or collars 43. These are received in mating receptacles or fitments carried by the back plate 20 and not specifically illustrated in the drawings.

The back plate 20 has a vertical wall depending from shelf 21 which supports the box. The vertical wall 22 generally serves as a compression pad against which the tube can be compressed upon actuation of the handle 31. Then, with the cartridge 40 in place on shelf 21 and the tube 41 extended as shown in FIG. 2, the nozzle 42 projects from the bottom of dispenser 10 so that material exiting the nozzle may be received in the hand of the user.

Figure 3:
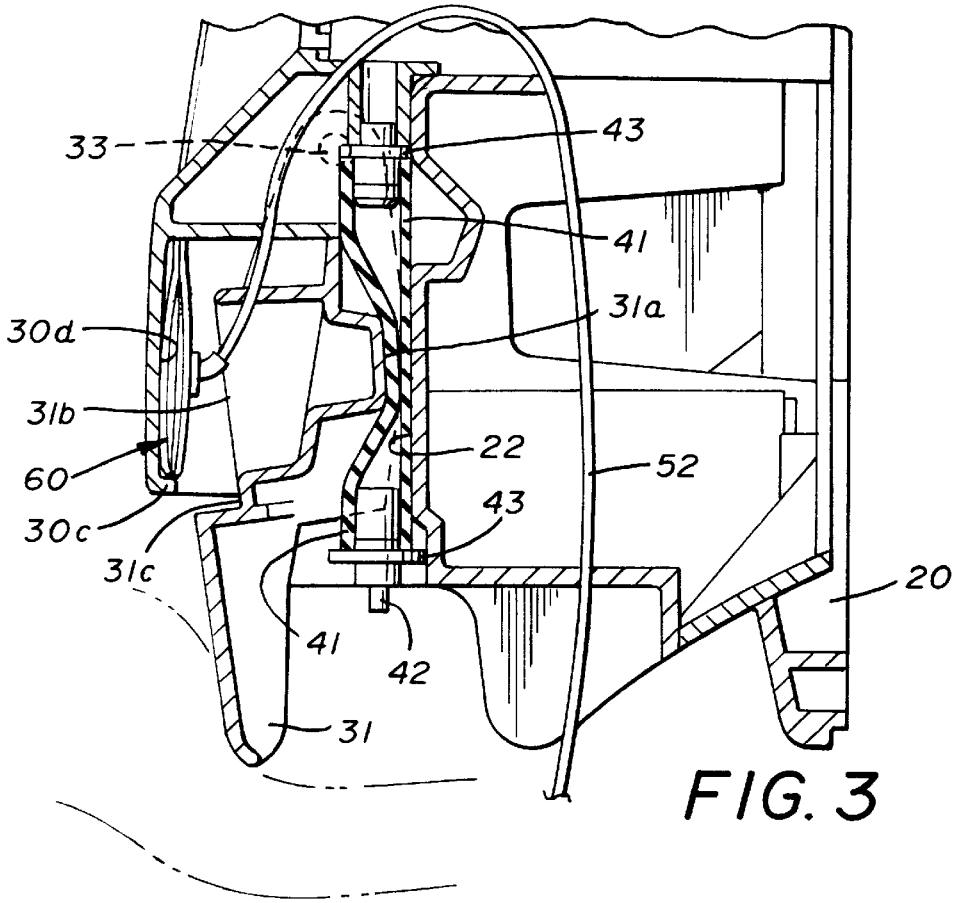
FIG. 3 is an enlarged elevational section view showing the operating mechanism being actuated by hand.

FIG. 2 of the drawings illustrates that the handle 31 is pivotally mounted to the cover, as at 33, and is movable inwardly toward the vertical wall or compression platen 22. The handle 31 has a compression surface 31*a* which engages the tube 41. In normal operation of this device, and as shown in FIG. 3 of the drawings, engagement of the handle 31 with the heel of the hand will move the handle to the right of FIG. 3, bringing the compression surface 31*a* into the tube 41 collapsing it against wall 22 and forcing material trapped in the tube out of the nozzle 42. Handle 31 also has a shoulder 31*c* while cover 30 has a corresponding shoulder 30*c*. These shoulders are in engagement with each other when the handle 31 is in the relaxed position of FIG. 2, thereby limiting movement of handle 31.

It will be noted that the improvement which is the subject of this application involves the bladder 60 and the foot pump 50. However, as can be seen in FIG. 3 of the drawings, provision of this mechanism in no way impedes operation of the dispenser in the conventional fashion by simply engaging the handle 31 and moving it inwardly to collapse the tube and dispense the material.

Figure 4:
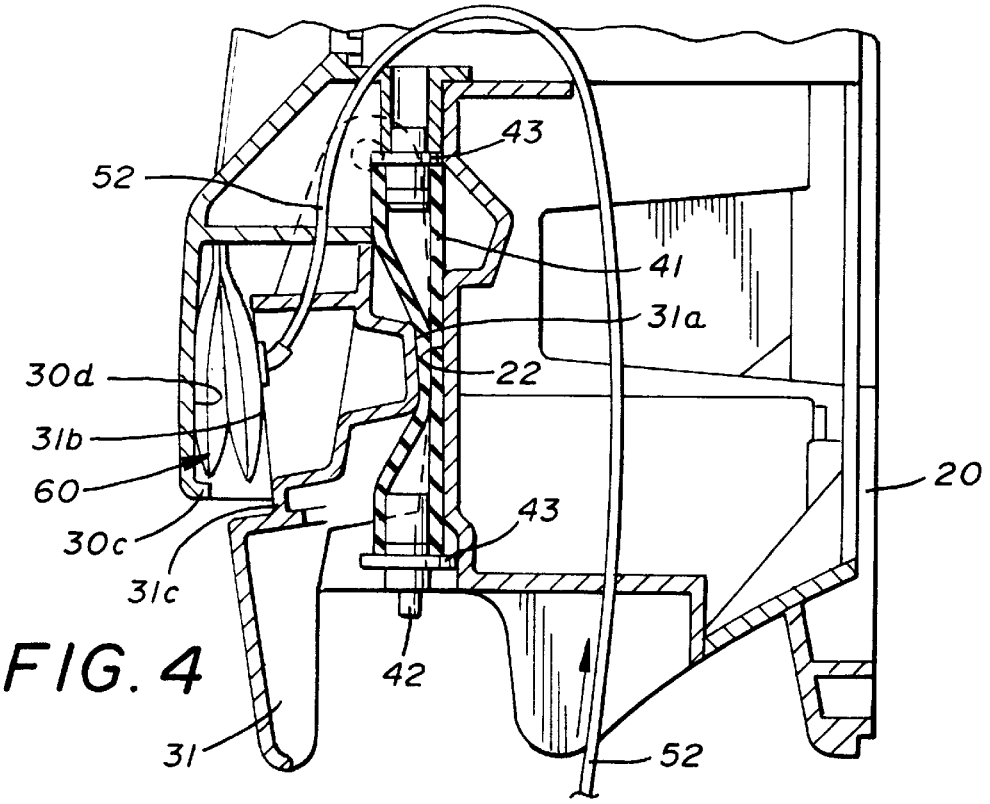
FIG. 4 is an enlarged elevational section view showing the operating mechanism being actuated by the foot pump.
Figure 5:
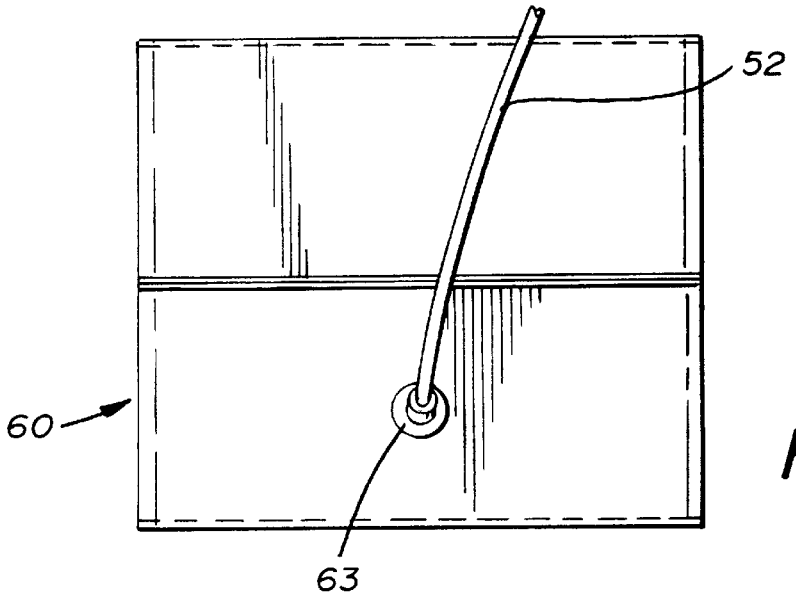
FIG. 5 is a plan view showing the bladder.
Figure 6:
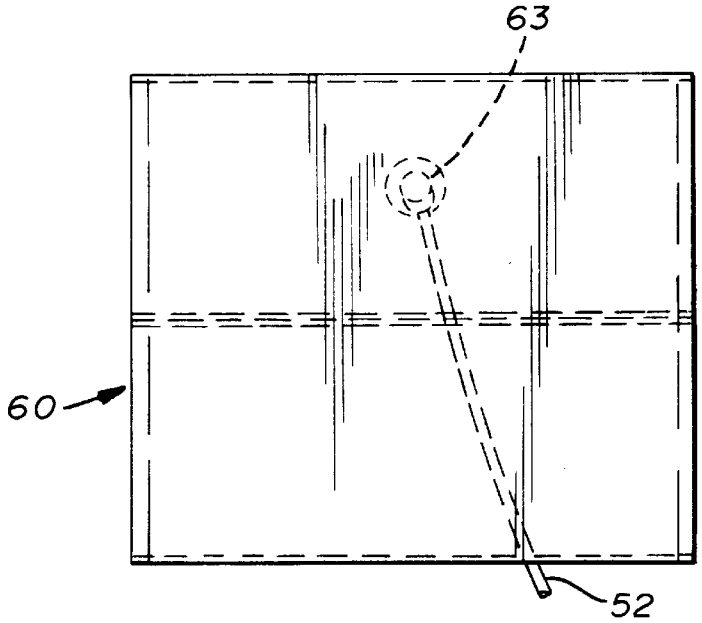
FIG. 6 is a plan view showing the bladder.
Figure 7:
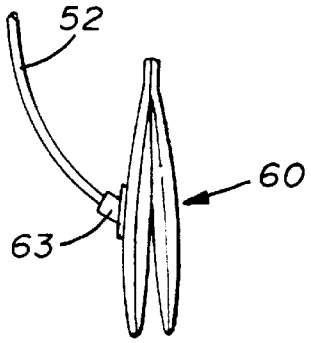
FIG. 7 is an elevational view showing the bladder in the collapsed condition.
Figure 8:
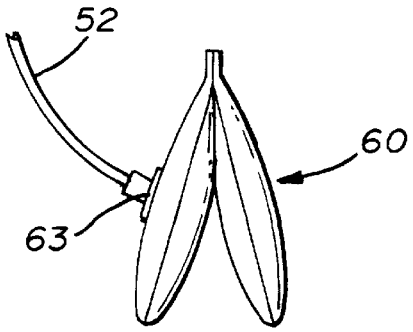
FIG. 8 is an elevational view showing the bladder in the expanded position.

Turning then to FIG. 4 of the drawings, it will be seen that the bladder 60 comprises a single closed chamber of flexible, air impervious material. One end of the tube 52 is received within the chamber 20 as to be able to supply air thereto as will be described. Tube 52 may be threaded through one of the openings in back plate 20. As previously noted, the other end of the tube 52 is in communication with the foot pump 50 so that collapse of the collapsible dome 51 of the foot pump 50 compresses the air and forces it through the tube 52 into the bladder 60. A comparison of FIGS. 2 and 4 of the drawings will show the expansion effect that this has on the bladder. Thus, in FIG. 2 of the drawings, the bladder 60 is in the relaxed position and the compression pad 31*a* of the handle 31 is essentially inactive, although it does contact the tube 41 at that time. However, upon stepping on the foot pump 50, the air from tube 52 causes bladder 60 to expand to the FIG. 4 condition with part of its outer surface bearing against the surface 31*b* of the handle 31 to pivot the handle and bring the compression pad 31*a* into collapsing engagement with the tube 41, thus dispensing the material.

Release of pressure on foot pump 50 permits the pressure member and handle 31 to return to the starting position whereupon the tube 41 is recharged in known fashion.

Furthermore, it will be noted that provision of a bladder-type arrangement like this makes it readily possible to actuate the dispenser in a hands-free mode. Furthermore, use of a bladder makes it possible to easily retrofit existing "push" type dispensers of this general type. As noted above, with reference to FIG. 2 of the drawings, the provision of the bladder would, in no way, interfere with hand or manual operation of the device if that were desired. Therefore, no modification is required to the existing structure in retrofitting.

Furthermore, it will be noted that the bladder is folded on itself and, when inflated, tends to bulge in the middle to apply concentrated pressure on surface 31*b*. This significantly increases the pressure on the tube 41 with no increase in the foot pressure required on pump 50. The material commonly dispensed from dispensers of this type is often highly viscous. Therefore, a fair amount of force is required to force it through the restricted opening of the nozzle 42. By using the folded bladder, the amount of pressure supplied with a given amount of foot pressure on the pump 50 is significantly increased. This avoids the necessity for repetitive pumping and also makes it significantly easier on the operator. Inasmuch as dispensers of this type are often used in healthcare settings, such as an operating room where time is of the essence and wherein the dispenser is more or less continuously in use, it is advantageous to render the device as user-friendly as possible.

In operation, the dispenser 10 can be retrofitted by simply inserting bladder 60 between the inner wall 30*d* of cover 30 and surface 31*b* of the pressure member with tube 52 threaded through the bottom or through the back plate of dispenser 10. The bladder assembly and dispenser are then ready for operation. Foot pressure to pump 50 will cause dispensing of the material from nozzle 42 in the same fashion as if the handle 31 had been operated manually.

While a full and complete description of the invention has been set forth in accordance with the dictates of the patent statutes, it should be understood that modifications can be resorted to without departing from the spirit hereof or the scope of the appended claims.

Thus, while a bladder folded about its midpoint has been illustrated and described, a triple fold may also be employed. In this fashion, the required foot pressure can be still further reduced because the pressure on the surface 31*b* of the handle 31 would be increased proportionately with no necessary increase in foot pressure on the foot pump 50.

What is claimed is:

1. A bladder assembly for activating a dispenser for fluid material of the type in which a pressure member is brought into collapsing engagement with a collapsible tube to pump the fluid material through the tube, the assembly comprising:

a) a flexible bladder forming an airtight chamber;

b) a foot pump;

c) an elongate tube having one end in fluid communication with the interior of said bladder and the other in fluid communication with said foot pump; and d) said bladder being removably positioned to engage the pressure member of the dispenser and move said pressure member into collapsing engagement with the tube.

2. The bladder assembly of claim 1 wherein said bladder is substantially elongate and rectangular in plan and is foldable.

3. The bladder assembly of claim 1 wherein said flexible bladder is substantially elongate and rectangular in plan and foldable about its approximate center line.

4. The bladder assembly of claim 1 wherein the dispenser includes a cover and the pressure member is hinged to the cover for movement toward and away from the collapsible tube wherein said bladder is removably positioned between said cover and said pressure member.

5. The bladder assembly of claim 1 wherein said bladder comprises a single chamber.

* * * * *

UNITED STATES PATENT AND TRADEMARK OFFICE
CERTIFICATE OF CORRECTION

PATENT NO : 5,996,851

DATED : December 07, 1999

INVENTOR(S): Michael J. Dolan, Akron, Ohio; John M. Tosill, Barberton Ohio; Edward L. Aman, Akron, Ohio It is certified that error appears in the above-identified patent and that said Letters Patent is hereby corrected as shown below:

Title Page: Item [75] Inventors:

Change Edward L. Aman to Edward L. Amann

Signed and Sealed this

Fifteenth Day of August, 2000

*Attest:*

Q. TODD DICKINSON

*Attesting Officer*

*Director of Patents and Trademarks*